US009370928B2

(12) United States Patent
Toda et al.

(10) Patent No.: US 9,370,928 B2
(45) Date of Patent: Jun. 21, 2016

(54) LIQUID EJECTING HEAD AND FABRICATING METHOD FOR LIQUID EJECTING HEAD

(71) Applicant: CANON KABUSHIKI KAISHA, Tokyo (JP)

(72) Inventors: Kyosuke Toda, Kawasaki (JP); Kiyomitsu Kudo, Machida (JP); Satoshi Kimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/721,246

(22) Filed: May 26, 2015

(65) Prior Publication Data

US 2015/0343774 A1 Dec. 3, 2015

(30) Foreign Application Priority Data

May 30, 2014 (JP) ..... 2014-112730
Apr. 8, 2015 (JP) ..... 2015-079181

(51) Int. Cl.
*B41J 2/17* (2006.01)
*B41J 2/14* (2006.01)
*B41J 2/16* (2006.01)

(52) U.S. Cl.
CPC ..... *B41J 2/1433* (2013.01); *B41J 2/14024* (2013.01); *B41J 2/14072* (2013.01); *B41J 2/162* (2013.01); *B41J 2002/14491* (2013.01); *Y10T 29/49403* (2015.01)

(58) Field of Classification Search
IPC ..... B41J 2/17526,2/1755, 2/17546
See application file for complete search history.

(56) References Cited

U.S. PATENT DOCUMENTS 7,832,818 B1 * 11/2010 McElfresh ..... 347/5
2010/0136850 A1 * 6/2010 Inaba ..... H01R 43/16 439/733.1

FOREIGN PATENT DOCUMENTS

JP 60-034870 A 2/1985

* cited by examiner

*Primary Examiner* — Shelby Fidler
*Assistant Examiner* — Tracey McMillion
(74) *Attorney, Agent, or Firm* — Fitzpatrick, Cella, Harper & Scinto

(57) ABSTRACT

There are provided a liquid ejecting head having a high fabrication efficiency and a high reliability of an electric connector, and a fabricating method for the liquid ejecting head. A direction in which a channel forming member is incorporated to a casing crosses a direction in which a flat spring is resiliently deformed. In incorporating the channel forming member, an abutment portion formed at the flat spring is allowed to abut on the casing, thus deforming the flat spring. The flat spring is brought into contact with an inside contact pad by a resilient restoring force of the flat spring.

17 Claims, 12 Drawing Sheets

LIQUID EJECTING HEAD AND FABRICATING METHOD FOR LIQUID EJECTING HEAD

BACKGROUND OF THE INVENTION

1. Field of the Invention

The present invention relates to a liquid ejecting head for ejecting liquid such as ink and a fabricating method for the liquid ejecting head.

2. Description of the Related Art

A liquid ejecting head is exemplified by an inkjet print head that is mounted on an inkjet printing apparatus and can eject ink. Japanese Patent Laid-open No. S60-34870 (1985) discloses a print head provided with a plurality of electrode pins in order to detect a remaining amount of ink staying in an ink channel at the print head. The remaining amount of ink staying in the ink channel can be detected based on a change of an electric resistance between the plurality of electrode pins. The electric resistance in a case where the ink stays in the ink channel is different from that in a case where no ink stays in the ink channel.

In a case where, for example, a channel forming member for forming the ink channel is formed independently of a main body of the print head, the electrode pin fixed to the channel forming member and a contact disposed at the main body of the print head are connected to each other via a conductive spring member or the like. In view of the structure of the print head, a direction in which the channel forming member is incorporated in the main body of the print head may cross a direction in which the spring member is compressively deformed. In this case, the channel forming member is incorporated, before the spring member is fixed.

However, a need of a step of fixing the spring member in addition to a step of incorporating the channel forming member in the above-described manner possibly induces the degradation of fabrication efficiency of the print head. Should the spring member be fixed to the channel forming member before the channel forming member is incorporated, the spring member interferes with the main body of the print head at the time of the incorporation, so as to lead to abnormal deformation, thereby raising a fear that a contact pressure required for electric connection cannot be secured.

SUMMARY OF THE INVENTION

The present invention provides a liquid ejecting head having a high fabrication efficiency and a high reliability of an electric connector, and a fabricating method for the liquid ejecting head.

In the first aspect of the present invention, there is provided a liquid ejecting head comprising:

a main body provided with an ejecting portion capable of ejecting liquid supplied through a liquid channel and an electric contact portion;

a channel forming member that is incorporated to the main body in a first direction so as to form the liquid channel; and a conductive flat spring that is fixed to the channel forming member and is brought into contact with the contact portion by a resilient restoring force in a case where the flat spring is deformed in a second direction crossing the first direction;

wherein the flat spring is provided with an abutment portion that abuts on the main body so as to resiliently deform the flat spring in the second direction in a case where the channel forming member is incorporated to the main body in the first direction.

In the second aspect of the present invention, there is provided a fabricating method for a liquid ejecting head comprising: a main body provided with an ejecting portion capable of ejecting liquid supplied through a liquid channel and an electric contact portion; a channel forming member that is incorporated to the main body in a first direction so as to form the liquid channel; and a flat spring that is fixed to the channel forming member and is brought into contact with the contact portion by a resilient restoring force in a case where the flat spring is deformed in a second direction crossing the first direction, the fabricating method comprising the step of: allowing an abutment portion of the flat spring to abut on the main body so as to resiliently deform the flat spring in the second direction in a case where the channel forming member is incorporated to the main body in the first direction.

In the third aspect of the present invention, there is provided a liquid ejecting head comprising:

a main body;

an ejecting portion capable of ejecting liquid supplied through a liquid channel;

an electric wiring board provided with a contact portion configured to receive a signal from the outside;

a channel forming member configured to form the liquid channel; and a conductive flat spring that is electrically connected to the contact portion, wherein the channel forming member is fixed to the main body via a fixing portion that is inserted into the main body in a first direction; and a through hole penetrating in a second direction crossing the first direction is formed at the main body, the conductive flat spring being electrically connected to the contact portion through the through hole in a resiliently deformed state in the second direction.

According to the present invention, in the configuration in which the first direction in which the channel forming member is incorporated in the main body and the second direction in which the flat spring is resiliently deformed cross each other, when the channel forming member is incorporated, the abutment portion of the flat spring can be allowed to abut on the main body so as to deform the flat spring in the second direction. In this manner, the contact pressure required for the electric connection between the flat spring and the contact is secured due to the resilient restoring force of the flat spring without inducing abnormal deformation of the flat spring, thus enhancing the reliability of the electric connection therebetween. Furthermore, since the channel forming member having the flat spring fixed thereto is incorporated in the main body, the flat spring and the channel forming member can be incorporated in one step, thus enhancing the fabrication efficiency of the liquid ejecting head.

Further features of the present invention will become apparent from the following description of exemplary embodiments (with reference to the attached drawings).

DESCRIPTION OF THE EMBODIMENTS

Embodiments of the present invention will be described below with reference to the attached drawings. Liquid ejecting heads in the embodiments below are inkjet print heads for ejecting ink as liquid in application examples.

First Embodiment

Figure 1A:
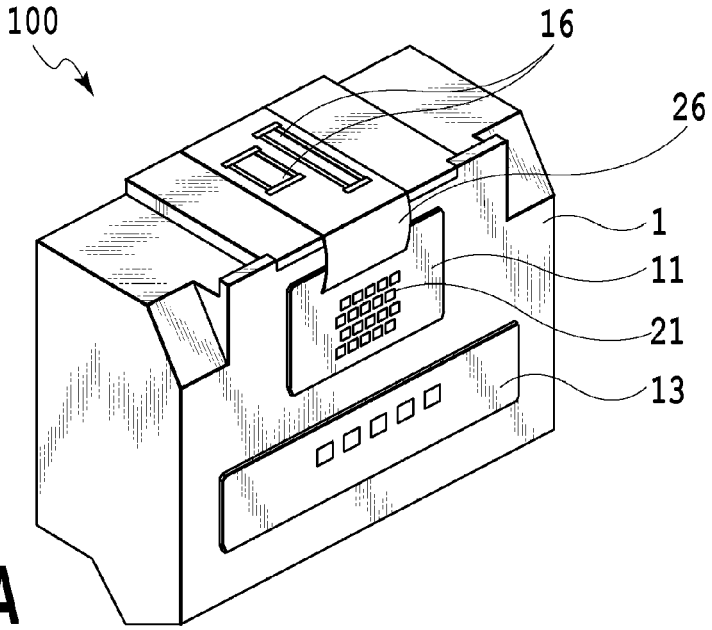
FIGS. 1A and 1B each are explanatory views showing a print head in a first embodiment of the present invention.

FIG. 1A is a perspective view showing an inkjet print head 100 in the present embodiment; and FIG. 1D is a cross-sectional view showing the print head 100. FIGS. 2A, 28, 3A, and 3B are perspective views in a step of assembling the print head 100.

A print element board (i.e., an ejecting unit) is provided with a plurality of ejection ports (not shown), and a plurality of ejection energy generating elements (not shown) such as electrothermal transducers (i.e., heaters) or piezoelectric elements. Ink and electric power are supplied to the print element board 16, so that the ink can be ejected from the ejection port. In a case where the electrothermal transducer is used as the ejection energy generating element, heat generated by the electrothermal transducer foams ink, and then, the use of its foaming energy enables the ink to be ejected from the ejection port.

The print element board 16 is secured at a position of a casing (i.e., a main body) 1, to which the ink is supplied through an ink channel 9. The print element board 16 is electrically connected to a first electric wiring board (i.e., a board for an element) 11 via an electric wiring member 26. The first electric wiring board 11 is provided with contact pads 21. In a case where the print head 100 is mounted on an inkjet printing apparatus, the contact pads 21 are electrically connected to contacts (not shown) at the printing apparatus. Electric power and a signal are supplied from the printing apparatus to the print element board 16 via these contacts and the contact pads 21. The print head 100 is provided with a channel forming member 5, at which a channel is formed in order to introduce the ink reserved in an ink tank (not shown) to the ink channel 9.

Figure 2A:
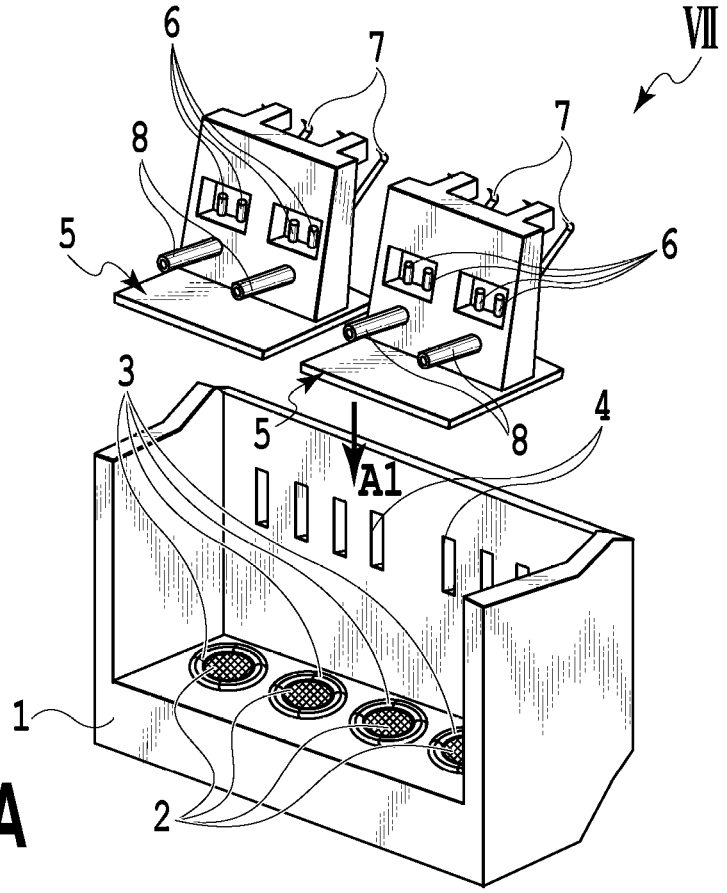
FIGS. 2A and 2B each are perspective views on the way of the incorporation of the print head shown in FIG. 1A.
Figure 2B:
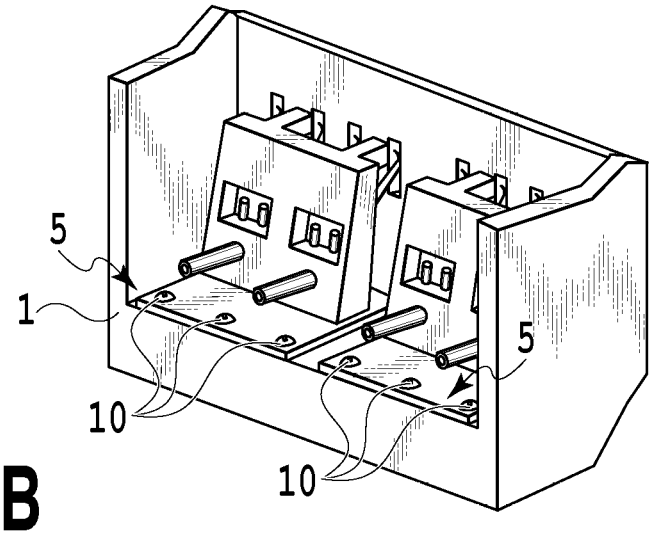

At the channel forming member 5, a tank connector 8 to be connected to the ink tank and an ink channel (i.e., a liquid channel) 18 are formed. The channel forming member 5 is fixed to the casing 1 via an elastic member 3 such as an O-ring. Consequently, the ink channel 18 and the ink channel 9 are connected to each other via a filter 2 that removes waste contained in the ink to be supplied from the ink tank, before the ink is supplied to the print element board 16. The print element board 16 in the present embodiment can eject inks of four colors, that is, yellow, magenta, cyan, and black. Thus, at the print element board 16, the four ink channels 9 for introducing these kinds of ink are formed. The print head 100 is provided with the two channel forming members 5, as shown in FIGS. 2A and 2B, for supplying these kinds of ink. One of the channel forming members 5 individually supplies two kinds of ink. In other words, at one of the channel forming members 5, the two tank connectors 8 connected to the two ink tanks, respectively, and the two ink channels 18 for supplying the inks to the corresponding ink channels 9 are formed. The kinds of ink to be ejected by the print head 100 may be one, and therefore, the number is not specified.

Figure 1B:
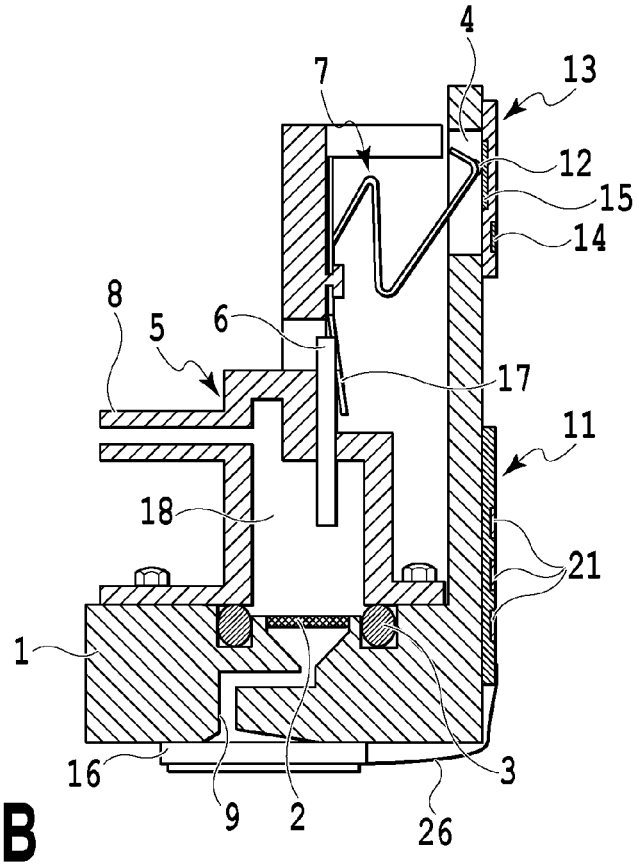

The ink channel 18 fulfills the functions of a temporary reservoir for the ink and a reservoir for bubbles contained in the ink. Two electrode pins 6 for detecting a remaining amount of ink staying in the ink channel 18 are securely inserted into the ink channel 18. In the present embodiment, the channel forming member 5 is a resin member molded with a resin material, and is injection-molded in a state in which the electrode pin 6 is previously inserted into a die by insert molding. In this manner, since the electrode pin 6 is fixed by the insert-molding, the incorporation of the electrode pin 6 can be completed at the same time in fabricating the channel forming member 5, thus eliminating the need of special preparation of a device for fixing the electrode pin 6 or other members. In the present embodiment, it is desirable that the electrode pin 6 should be fixed in a direction in which the ink channel 18 extends (i.e., a vertical direction in FIG. 1B) in view of the structure of the die. The method for securely inserting the electrode pin 6 is not limited to the method by the insert-molding, like the present embodiment. For example, fixture by press-fitting or via an adhesive may be adopted. Alternatively, the electrode pin 6 may be fixed in a lateral direction in FIG. 1D. The insertion direction of the electrode pin 6 may be arbitrarily selected from the vertical direction, a horizontal direction, and the like in FIG. 1B according to a fixing method of the electrode pin 6 to the channel forming member 5.

A base end of a conductive thin flat spring 7 is fixed to the channel forming member 5. A contact 17 to be electrically connected to the electrode pin 6 is disposed at the base end of the flat spring 7. In the meantime, another contact 12 is disposed at a tip end of the flat spring 7. The contact 12 is connected to an inside contact pad 15 of a second electric wiring board (i.e., a board) 13 through a through hole 4 formed at the casing 1. The second electric wiring board 13 attached to the casing 1 is provided with an outside contact pad 14 to be electrically connected to the outside (i.e., the printing apparatus), for receiving electric power or a signal to be supplied from the outside. The print head 100 is mounted on the printing apparatus, so that the printing apparatus and the two electrode pins 6 inside of the ink channel 18 can be electrically connected to each other via the outside contact pad 14, the inside contact pad 15, and the flat spring 7. An electric resistance between the electrode pins 6 is measured, so that the existence of the ink between the electrode pins 6 can be detected.

FIGS. 4A, 4B, 5A, and 5B are cross-sectional views illustrating the procedures for assembling the print head 100.

In fixing the channel forming member 5 to the casing 1 via the elastic member 3, it is necessary to compress the elastic member 3 in a direction in which the ink channels 9 and 18 are connected to each other in order to stably secure the sealability of the elastic member 3 at a connecting portion between the ink channels 9 and 18. In the present embodiment, the direction in which the ink channel 18 is connected to the ink channel 9 is indicated by an arrow A1 (i.e., a first direction) in FIGS. 2A, 4A, and 4B. The channel forming member 5 is incorporated in the casing 1 in this connection direction, thereby compressing the elastic member 3. Screws 10 serving as fixing portions are inserted in the direction indicated by the arrow A1 so that the channel forming member 5 is fixed to the casing 1, as shown in FIG. 5A. Incidentally, a method for fixing the channel forming member 5 and the casing 1 to each other via not the screws 10 but caulking, elastic engagement, bonding, or the like can be used according to the present invention.

Figure 3A:
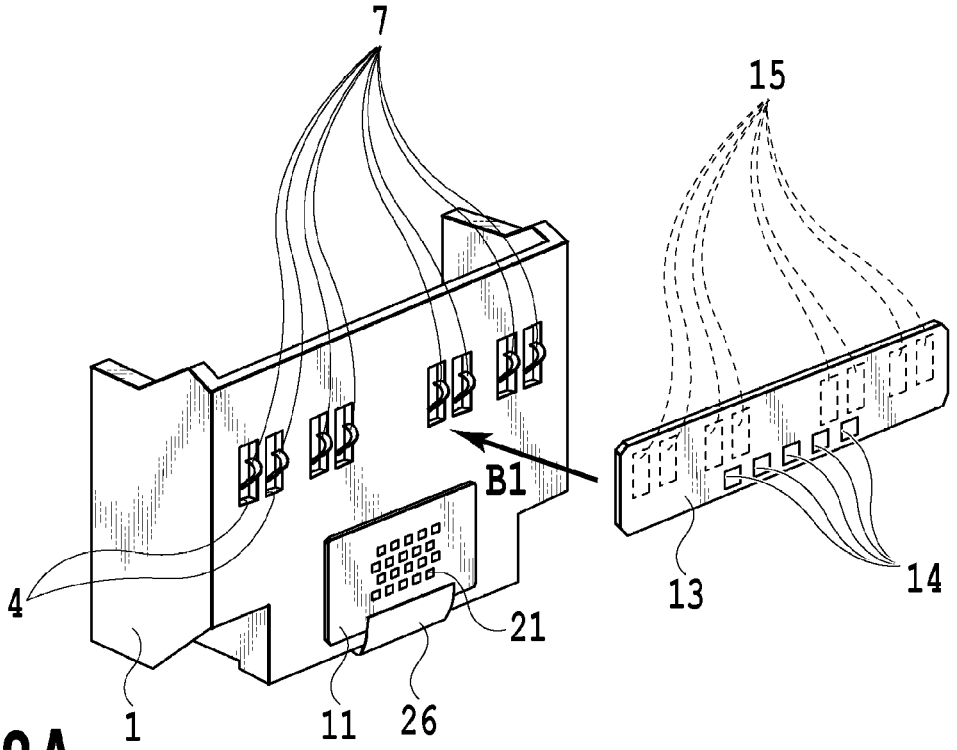
FIGS. 3A and 3B each are perspective views on the way of the incorporation of the print head shown in FIG. 1A.
Figure 3B:
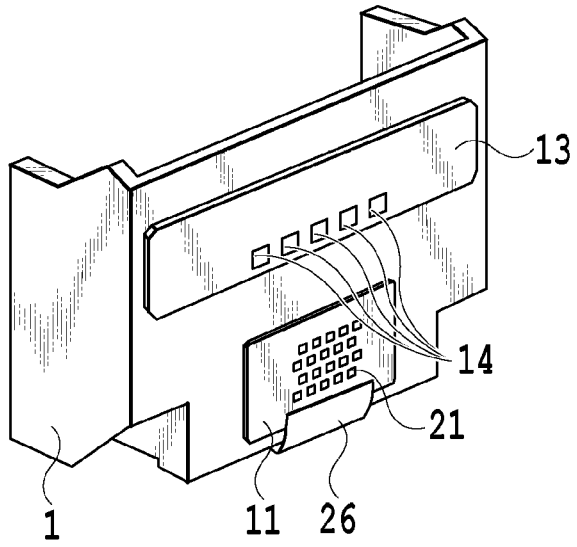

In mounting the print head 100 on the printing apparatus, it is necessary to electrically connect the second electric wiring board 13 to the printing apparatus, like the first electric wiring board 11. In view of this, as shown in FIGS. 3A and 3B, it is desirable that the second electric wiring board 13 should be arranged at the same side of the casing 1 as that of the first electric wiring board 11. Furthermore, like the present embodiment, it is more desirable that the first and second electric wiring boards 11 and 13 should be arranged within the same plane at the side of the casing 1. Specifically, the first and second electric wiring boards 11 and 13 are arranged on the same plane, and further, it is desirable that electric contacts of the printing apparatus should be arranged on the same plane at the side of the printing apparatus facing the first and second electric wiring boards 11 and 13 in a case where the print head 100 is mounted on the printing apparatus. In a case where the electric wiring boards 11, 13, and the electric contacts are arranged in the above-described manner, the print head 100 is mounted on the printing apparatus, so that the first and second electric wiring boards 11 and 13 can be electrically connected to the electric contacts facing the first and second electric wiring boards 11 and 13 at the side of the printing apparatus.

Figure 5A:
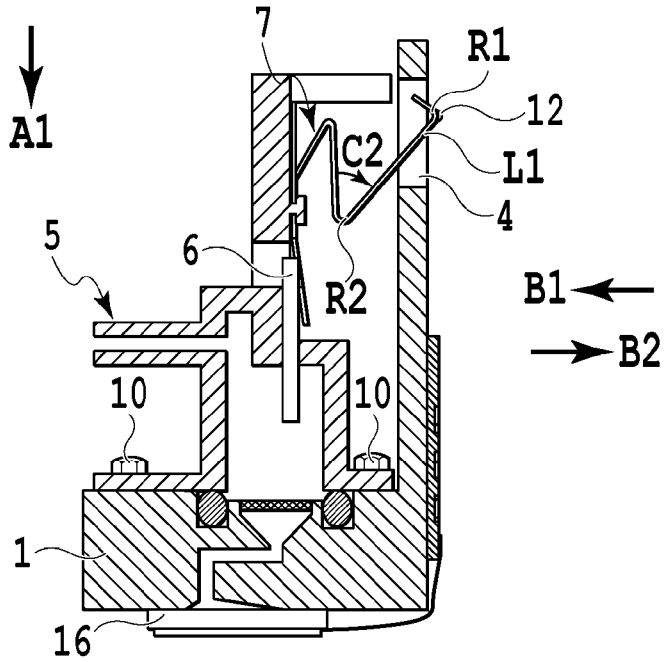
FIGS. 5A and 5B each are cross-sectional views illustrating the incorporating step of the print head shown in FIG. 1A.
Figure 5B:
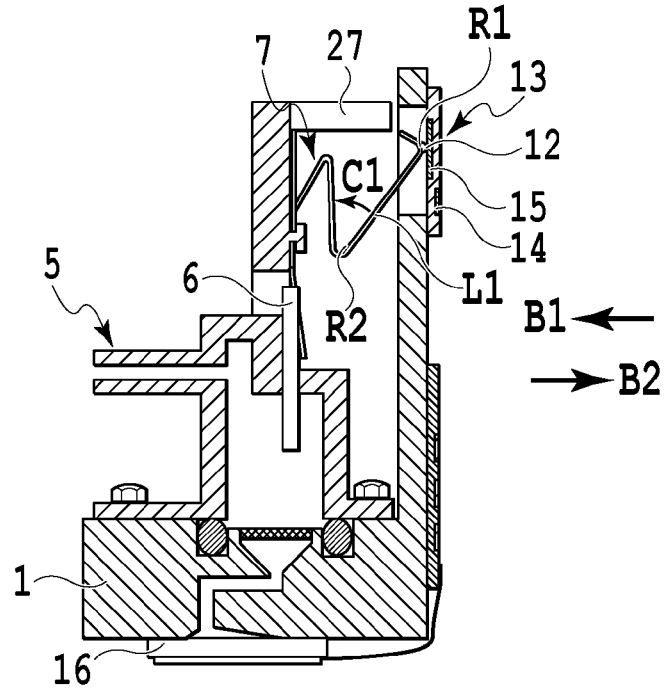

In the state in which the channel forming member 5 is secured to the casing 1, as shown in FIGS. 3A and 5A, the contact 12 of the flat spring 7 penetrates the through hole 4 formed at the casing 1, and then, projects outward (i.e., rightward in FIG. 5A) of the surface of the casing 1, at which the second electric wiring board 13 is to be arranged. The through hole 4 allows the flat spring 7 to be deformed in a direction indicated by an arrow B2 by a resilient restoring force of the flat spring 7. The second electric wiring board 13 includes the inside contact pad 15 to be connected to the flat spring 7 and the outside contact pad 14 to be connected to the printing apparatus, as described above. The second electric wiring board 13 is fixed to the casing 1 such that the inside contact pad 15 is pressed against the contact 12 of the flat spring 7 in a direction indicated by an arrow B1 (i.e., a second direction), as shown in FIGS. 3A and 5B. The second electric wiring board 13 is fixed to the casing 1 in this manner such that the flat spring 7 is compressively deformed in the direction indicated by the arrow B1, so that a contact pressure required for the electric connection between the contact 12 and the inside contact pad 15 is secured by the resilient restoring force of the flat spring 7. In other words, the flat spring 7 is brought into contact with the inside contact pad 15 in the resiliently deformed state. In the present embodiment, the channel forming member 5 is fixed to the casing 1, as shown in FIGS. 2A and 2B, before the second electric wiring board 13 is fixed to the casing 1, as shown in FIGS. 3A and 3B. To the contrary, the second electric wiring board 13 may be fixed to the casing 1, before the channel forming member 5 is fixed to the casing 1. Alternatively, an electric wiring board having both of the functions of the first and second electric wiring boards 11 and 13 may be formed, and then, the electric wiring board may be fixed to the casing 1.

Figure 4A:
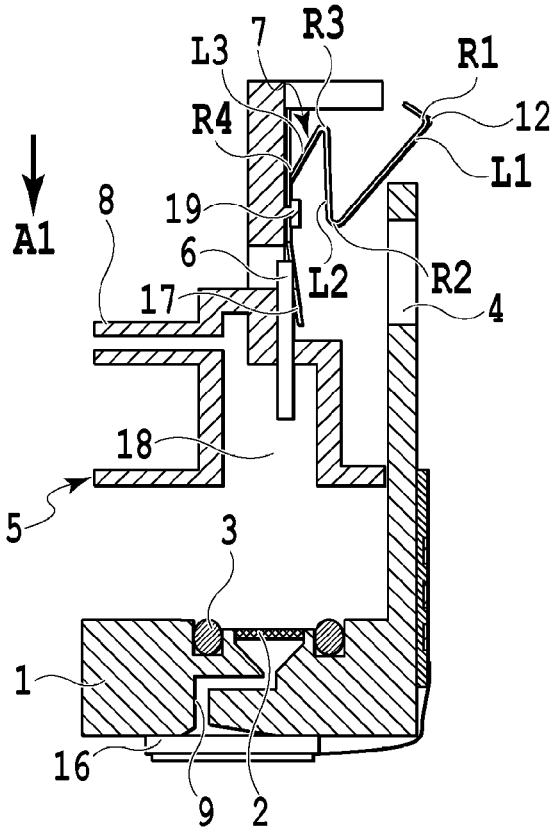
FIGS. 4A and 4B each are cross-sectional views illustrating an incorporating step of the print head shown in FIG. 1A.

In the flat spring 7 in the present embodiment, its base end is fixed to the channel forming member 5 via a fixing portion 19, as shown in FIG. 4A. Four bent portions R1, R2, R3, and R4 are formed from the tip end toward the base end. The bent portion R1 is curved at about 90°, and has the contact 12. The bent portions R2 and R3 are curved at an acute angle whereas the bent portion R4 is curved at an obtuse angle. Flat portions L1, L2, and L3 are formed at the flat spring 7 between these bent portions R1, R2, R3, and R4.

Figure 7:
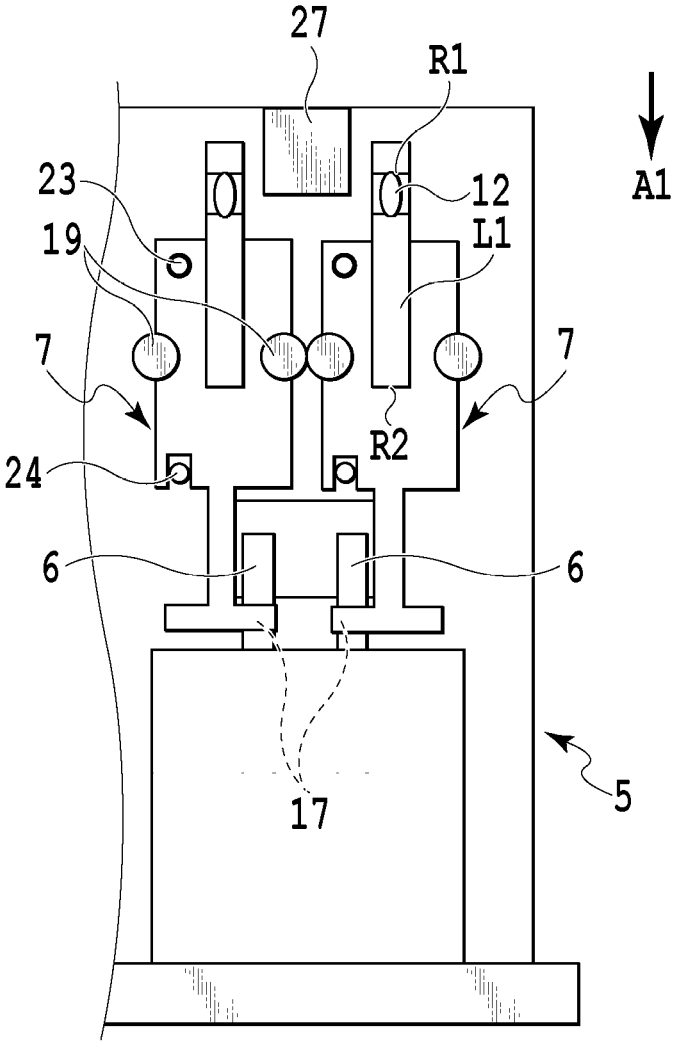
FIG. 7 is a back view showing a channel forming member shown in FIG. 2A, as viewed in a direction indicated by an arrow VII.

FIG. 7 is a back view showing the channel forming member 5 having the flat springs 7 fixed thereto, as viewed in a direction indicated by an arrow VII in FIG. 2A. The flat spring 7 in the present embodiment includes a wide base end that is fixed to the channel forming member 5 and a narrow portion at which the bent portions R1, R2, R3, and R4 and the flat portions L1, L2, and L3 are formed. As described above, in the channel forming member 5, the two electrode pins 6 are securely positioned at one of the ink channels 18 on the right and left sides in FIG. 7. The flat spring 7 is independently connected to each of the electrode pins 6. In the present embodiment, the base end of the flat spring 7 is formed into an inverse T-shape, as shown in FIG. 7. The contacts 17 to be connected to the electrode pins 6 are disposed on the right and left sides of the inversely T-shaped portions. Specifically, as shown in FIG. 7, the contact 17 on the right side of the inversely T-shaped portion of the left flat spring 7 is electrically connected to the left electrode pin 6. In contrast, the contact 17 on the left side of the inversely T-shaped portion of the right flat spring 7 is electrically connected to the right electrode pin 6. Consequently, the flat springs 7 having the same shape can be connected to the right and left electrode pins 6 shown in FIG. 7, respectively. The inversely T-shaped portion at the base end of the flat spring 7 can secure the contact pressure of the contact 17 with respect to the electrode pin 6 by utilizing the resilient deformation of the narrow portion.

The wide base end of the flat spring 7 is fixed to the channel forming member 5 via the fixing portion 19, as described above. Since the channel forming member 5 in the present embodiment is made of a resin, the fixing portion 19 is thermally caulked at the channel forming member 5, thereby fixing the flat spring 7. However, the fixing method for the flat spring 7 is not limited to the thermal caulking, and therefore, it is arbitrary. At the channel forming member 5, a positioning pin 23 for positioning the flat spring 7 and a turn stopping pin 24 for stopping a turn of the flat spring 7 are formed. With this configuration, the plurality of flat springs 7 can be accurately fixed on the same plane of the channel forming member 5. In the present embodiment, four flat springs 7 in total are fixed to one channel forming member 5.

Figure 4B:
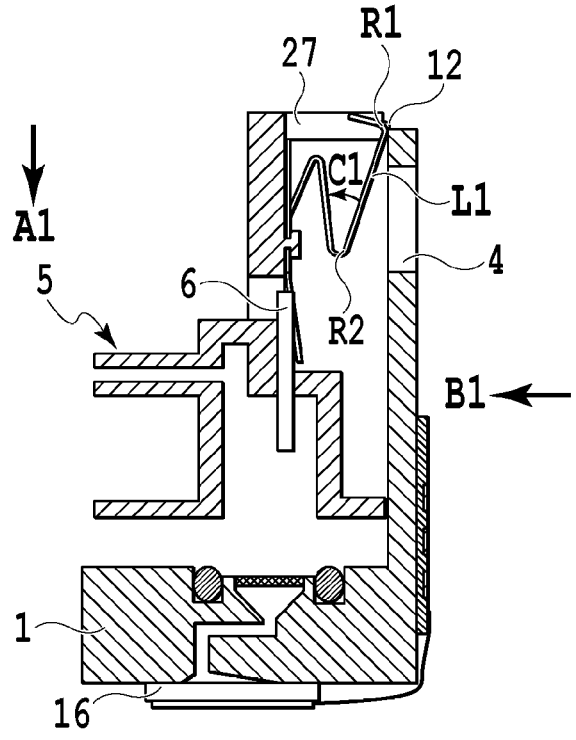

The channel forming member 5 having the above-described flat springs 7 fixed thereto is incorporated in the casing 1 in the direction indicated by the arrow A1, as described above. At this time, as shown in FIGS. 4A and 4B, a portion (i.e., an abutment portion) of the flat portion L1 interposed between the bent portions R1 and R2 abuts on the casing 1, thus deforming the flat spring 7 in the direction indicated by the arrow B1. The flat portion L1 is formed in such a manner as to be inclined in the direction indicated by the arrow A1, so that the portion of the flat portion L1 that abuts on the casing 1 is gradually shifted from the bent portion R2 toward the bent portion R1 according to the movement of the channel forming member 5 in the direction indicated by the arrow A1. In this manner, the flat portion L1 is turned on the bent portion R2 in a direction indicated by an arrow C1 while the flat spring 7 is compressively deformed in the direction indicated by the arrow B1. The flat spring 7 is designed such that the resilient restoring force cannot be reduced even in a most compressed state shown in FIG. 4B. The channel forming member 5 is provided with a compression restrictor 27 for restricting the deformation of the flat spring 7 in a widthwise direction (i.e., a lateral direction in FIG. 7). In a case where the channel forming member 5 is moved to a movement limitation position in the direction indicated by the arrow A1, that is, an incorporation position, the flat spring 7 is released from the compression, as shown in FIG. 5A, so that the flat portion L1 is turned on the bent portion R2 in a direction indicated by an arrow C2 while the flat spring 7 is resiliently restored in a direction indicated by an arrow B2. In this manner, the contact 12 projects from the through hole 4 formed at the casing 1. The channel forming member 5 is fixed to the casing 1 at the incorporation position shown in FIG. 5A.

Thereafter, as shown in FIG. 5B, the second electric wiring board 13 is securely fixed to the casing 1 in the direction indicated by the arrow D1 in which the flat spring 7 is compressed. The flat portion L1 is turned on the bent portion R2 in the direction indicated by the arrow C1 while the flat spring 7 is compressively deformed in the direction indicated by the arrow B1. The contact pressure required for electrically connecting the contact and the inside contact pad 15 of the second electric wiring board 13 is secured by the resilient restoring force generated at the flat spring 7 in the direction indicated by the arrow B2.

Figure 6A:
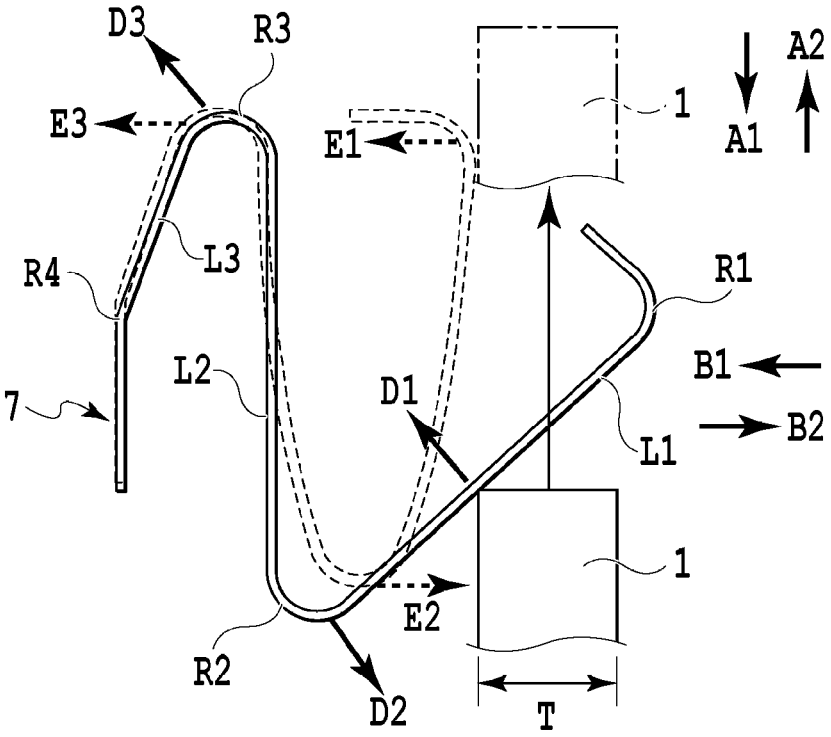
FIGS. 6A and 6B each are explanatory views showing a flat spring at the print head shown in FIG. 1A.

In a case where the print head 100 is mounted on the printing apparatus, the print head 100 need be positioned with high accuracy, and therefore, a certain degree of rigidity is required for the casing 1. Therefore, the casing 1 requires a certain degree of thickness T, as shown in FIG. 6A. Here, the length of the through hole 4 in the lateral direction in FIG. 4A is equal to the thickness T.

In FIG. 6A, solid lines indicate a shape of the flat spring 7 immediately before the compressive deformation shown in FIG. 4A: in contrast, broken lines indicate a shape of the flat spring 7 in the most compressively deformed state shown in FIG. 4B. For the sake of convenience of explanation, the relationship between the flat spring 7 and the casing 1 is expressed in FIG. 6A on the assumption that the casing 1 is moved in the direction (indicated by the arrow A2), reverse to the direction (indicated by the arrow A1), with respect to the channel forming member 5 having the flat spring 7 fixed thereto. As in the present embodiment, the formation of the plurality of bent portions R1, R2, R3, and R4 and flat portions L1, L2, and L3 is effective in setting the sufficiently large maximum displacements of the flat spring 7 in the directions indicated by the arrows B1 and B2 so as to secure the satisfactory contact pressure between the contact 12 and the inside contact pad 15. The numbers of bent portions and flat portions to be formed are not specified to four and three in the present embodiment, respectively, and therefore, they are arbitrary. The radius of the bent portion, the length of the flat portion, and the numbers of bent portions and flat portions are further increased, thus setting the sufficiently large maximum displacements of the flat spring 7 in the directions indicated by the arrows B1 and B2. However, the longer the flat portion, the greater the turn radius in a case where the flat portion is turned, as described above, thereby increasing the sizes required for the flat spring 7 and the through hole 4. The greater size of the through hole 4 degrades the rigidity of the print head 100, and further, degrades the positioning accuracy of the print head 100. In order to stably deform the flat spring 7 while the flat portion is turned, and further, reduce the size of the through hole 4, it is desirable to design a flat spring 7 having a smaller turn radius of a flat portion.

Figure 6B:
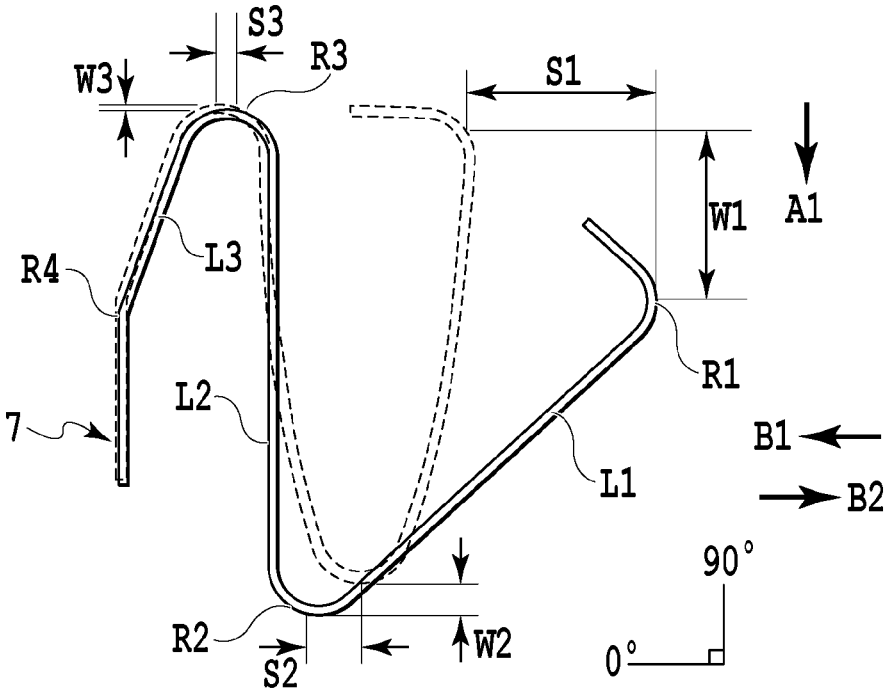

In FIG. 6A, solid arrows D1, D2, and D3 show directions, in which weights exert on the flat portion L1 and the bent portions R2 and R3 immediately after the start of the deformation of the flat spring 7: in contrast, broken arrows E1, E2, and E3 show directions, in which weights exert on the bent portions R1, R2, and R3 at the time of the maximum deformation of the flat spring 7. In FIG. 6B, reference characters S1, S2, and S3 designate the respective displacements of the bent portions R1, R2, and R3 in the directions indicated by the arrows B1 and B2, and further, reference characters W1, W2, and W3 denote the respective displacements of the bent portions R1 (i.e., the contact 12), R2, and R3 in the directions indicated by the arrows A1 and A2 perpendicular to the directions indicated by the arrows B1 and B2. Simply speaking, in a case where the flat portion L1 is turned on the bent portion R2, an approximate value of the displacement S1 of the bent portion R1 (i.e., the contact 12) in the direction indicated by the arrow B1 by the turn can be obtained by using cos θ, wherein θ represents a turn angle. The displacement S1 at a rotational angle of 1° of cos θ becomes maximum in a case where the extension direction of the flat portion L1 becomes about 90° with respect to the direction indicated by the arrow B1. Specifically, the flat spring 7 is designed such that the angle of the flat portion L1 becomes 90° at the time of the maximum deformation of the flat spring 7 assuming that an angle with respect to the direction indicated by the arrow B1 is 0°, thus efficiently setting the large displacement S1 of the bent portion R1 (i.e., the contact 12).

The bent portions R2 and R3 are bent portions (i.e., first bent portions) whose bend angles are reduced in a case where the flat spring 7 is resiliently deformed in the direction indicated by the arrow B1. In contrast, the bent portion R4 is a bent portion (i.e., a second bent portion) whose bend angle is increased in a case where the flat spring 7 is resiliently deformed in the direction indicated by the arrow B1.

In a case where the length of the through hole 4 in the lateral direction in FIG. 4A is equal to the thickness T of the casing 1 (see FIG. 6A), the interrelationships among the length T of the through hole 4, the displacement S2 of the bent portion R2, and the displacement S1 of the bent portion R1 (i.e., the contact 12) are expressed by the inequality: $T<(S1-S2)$. Consequently, the flat spring 7 can be displaced through the through hole 4 without any contact of the bent portion R2 with the casing 1 irrespective of the fixture mode of the flat spring 7. The displacement of each of the bent portions can be adjusted according to the length of the flat portion, the angle of the bent portion, the width of the flat portion, and the like. For example, a hole or a narrow and fine portion may be formed at the flat portion and/or the bent portion, so that the displacement of each of the bent portions may be adjusted.

In the present embodiment, the direction indicated by the arrow A1 in which the channel forming member 5 is incorporated in the casing 1 crosses the direction indicated by the arrow B1 in which the flat spring 7 is resiliently deformed. However, the abutment portion of the flat spring 7 is allowed to abut on the casing 1 so as to deform the flat spring 7 in the direction indicated by the arrow B1 in incorporating the channel forming member 5, thus preventing any fear of occurrence of abnormal deformation of the flat spring 7. As a consequence, the resilient restoring force of the flat spring 7 can sufficiently secure the contact pressure required for the electric connection between the flat spring 7 and the inside contact pad 15. The channel forming member 5 having the flat spring 7 fixed thereto is incorporated in the casing 1, and therefore, the flat spring 7 and the channel forming member 5 can be incorporated in one step, thus enhancing the fabrication efficiency of the print head 100.

Figure 12:
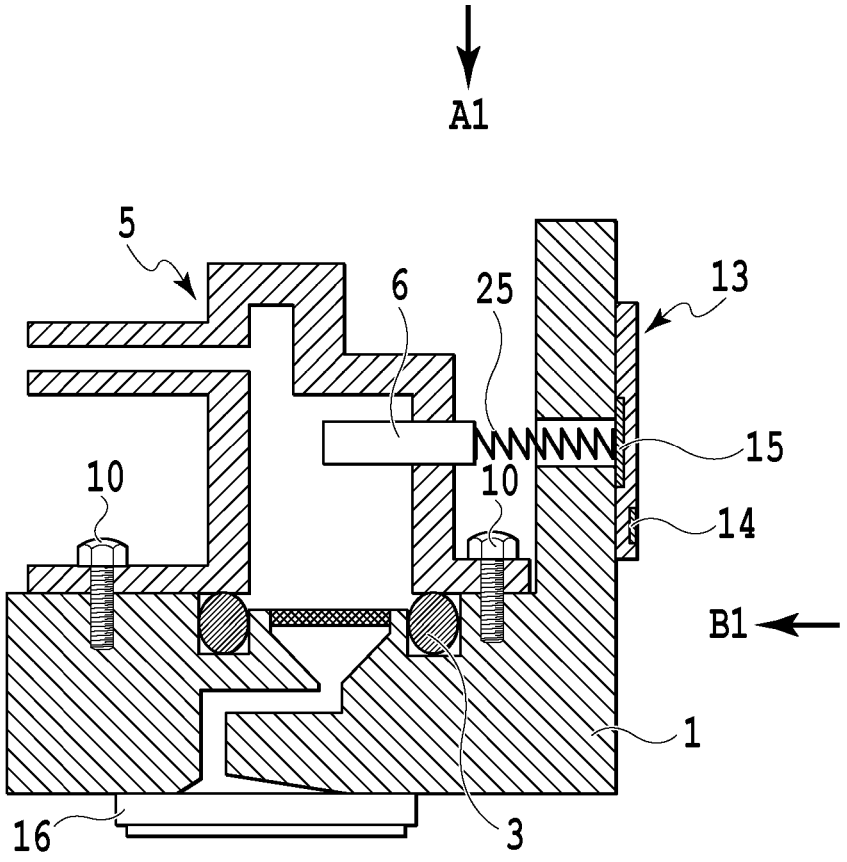
FIG. 12 is a cross-sectional view showing a print head in a comparative example.

FIG. 12 is a cross-sectional view showing a print head in a comparative example. An electrode pin 6 disposed on the side of a channel forming member 5 and an inside contact pad 15 disposed on the side of a casing 1 are electrically connected to each other via a conductive coil spring 25. The electrode pin 6 is fixed to the channel forming member 5 in such a manner as to extend in a lateral direction in FIG. 12. In assembling the above-described print head, the coil spring 25 need be fixed in a direction indicated by an arrow B1, after the channel forming member 5 is incorporated in the casing 1 in a direction indicated by an arrow A1. In view of this, in addition to the incorporating step of the channel forming member 5, a fixing step of the coil spring 25 is needed, thereby inducing a fear of degradation of fabrication efficiency of a print head. Should the incorporation of the channel forming member 5 follow the fixture of the coil spring 25 to the channel forming member 5, the coil spring is abnormally deformed during the incorporation, thus inducing a fear that a contact pressure required for electric connection cannot be secured.

Second Embodiment

Figure 8:
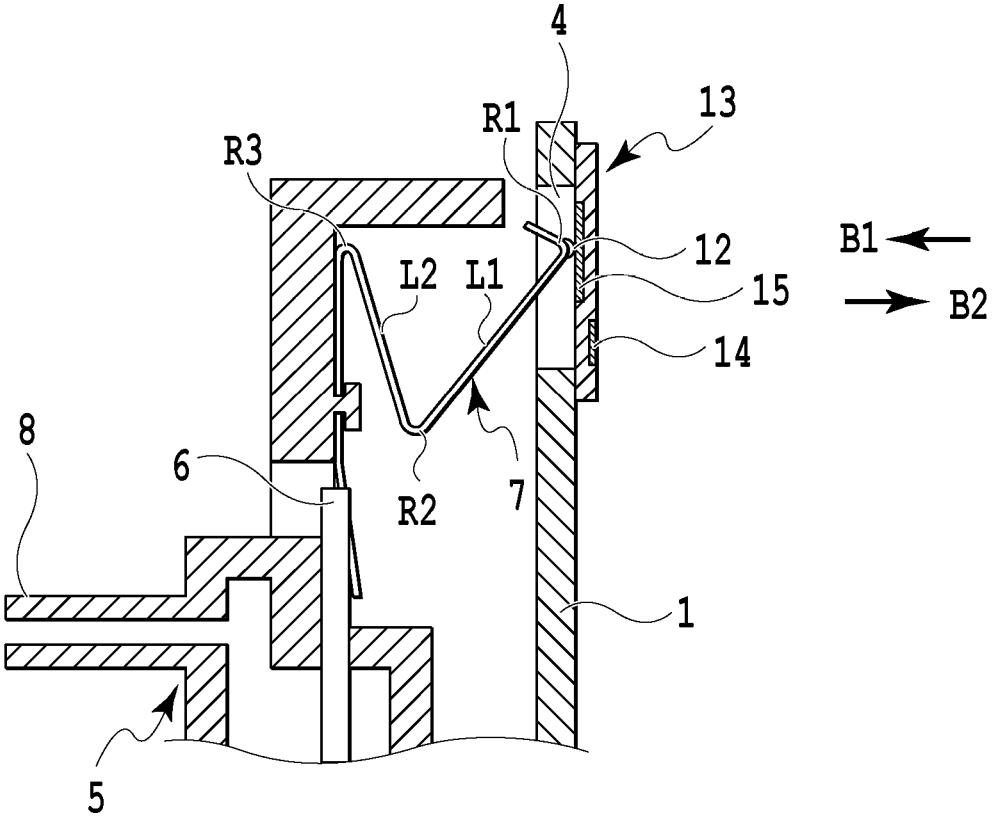
FIG. 8 is a cross-sectional view showing essential parts of a print head in a second embodiment of the present invention.

FIG. 8 is a cross-sectional view showing essential parts of a print head in a second embodiment of the present invention.

In a case where rigidity required for the print head 100 is low, and therefore, the thickness T of the casing 1 can be reduced, the length of the through hole 4 can be reduced, like the thickness T, thus reducing a largest displacement required for the bent portion R1 (i.e., the contact 12) in directions indicated by arrows B1 and B2. In this case, it is desirable that the number of bent portions to be formed at the flat spring 7 should be reduced from the viewpoint of the stability of the shape of the flat spring 7, like the present embodiment. Three bent portions R1, R2, and R3 and two flat portions L1 and L2 are formed at the flat spring 7. Thus, it is possible to secure the displacement of the flat spring 7 according to the short through hole 4 so as to stably deform the flat spring 7.

Third Embodiment

Figure 9:
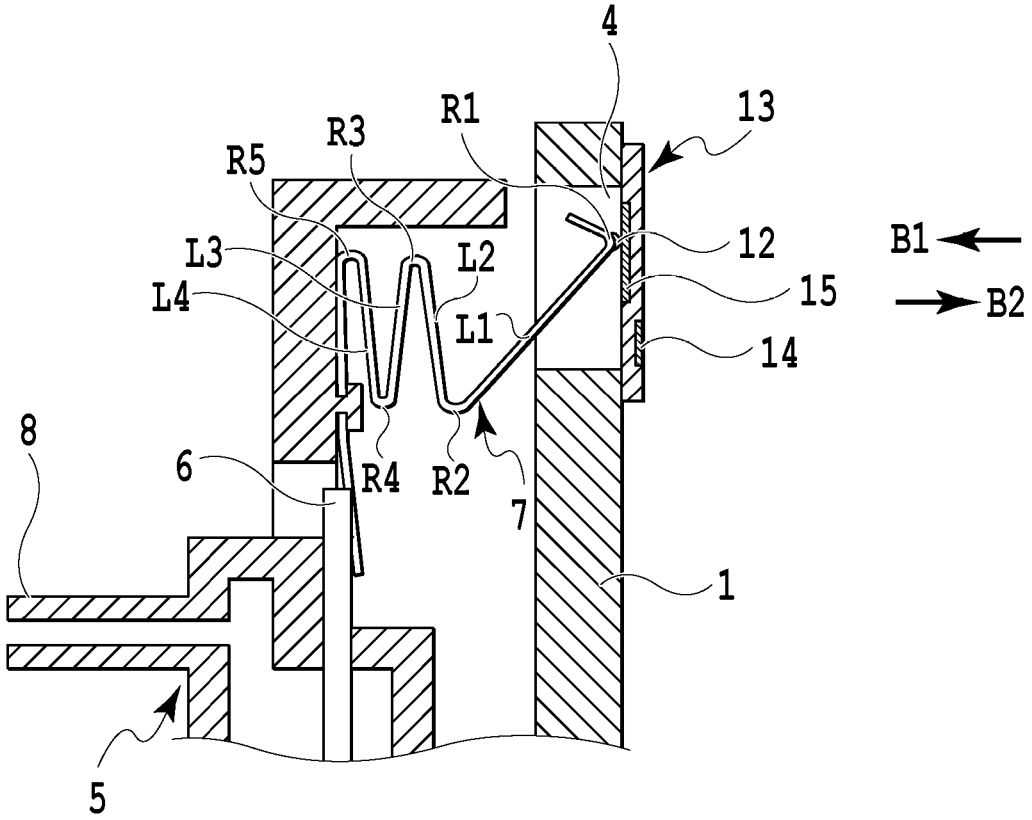
FIG. 9 is a cross-sectional view showing essential parts of a print head in a third embodiment of the present invention.

FIG. 9 is a cross-sectional view showing essential parts of a print head in a third embodiment of the present invention.

In a case where rigidity required for the print head 100 is high, and therefore, the thickness T of the casing 1 is increased, the length of the through hole 4 can be increased, like the thickness T, thus increasing a largest displacement required for the bent portion R1 (i.e., the contact 12) in directions indicated by arrows B1 and B2. In this case, it is possible to increase the number of bent portions to be formed at the flat spring 7 so as to secure the satisfactory displacement of the flat spring 7 according to the long through hole 4, like the present embodiment. Five bent portions R1, R2, R3, R4, and R5 and four flat portions L1, L2, L3, and L4 are formed at the flat spring 7 in the present embodiment.

Fourth Embodiment

Figure 10:
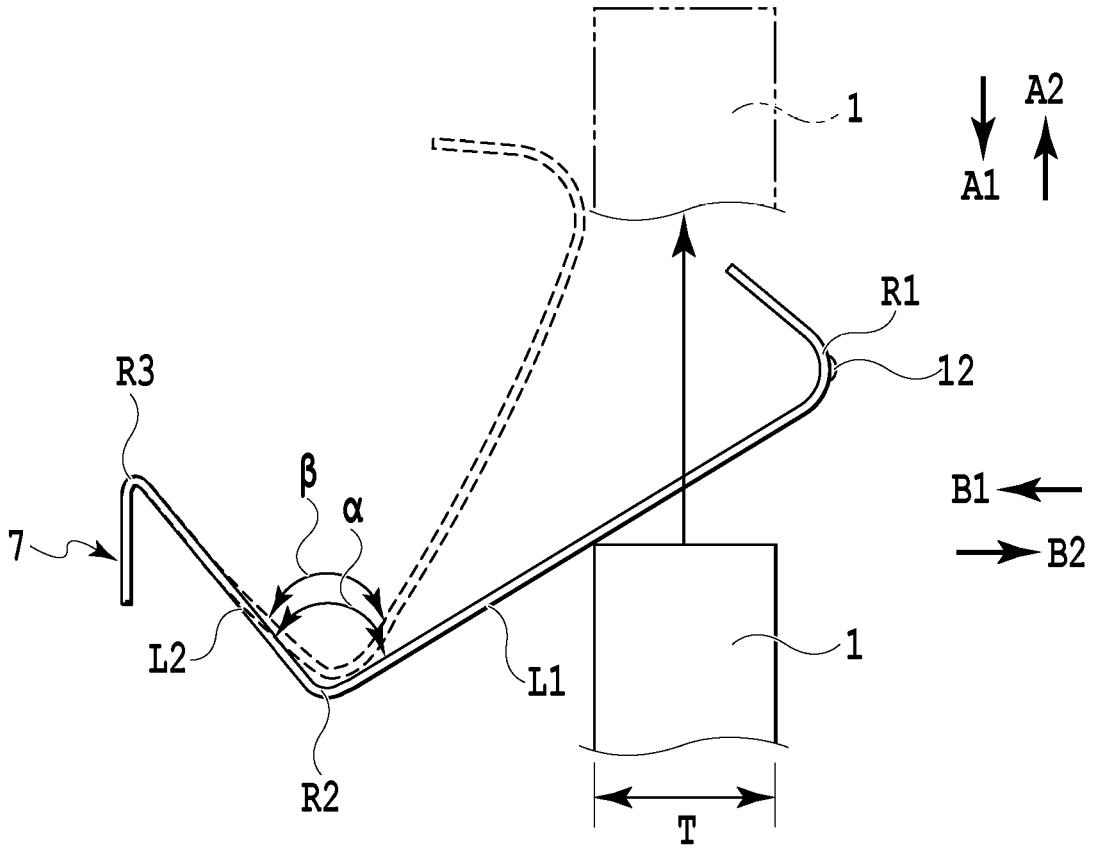
FIG. 10 is an explanatory view showing a flat spring in a fourth embodiment of the present invention.

FIG. 10 is an explanatory view showing a flat spring 7 in a fourth embodiment of the present invention.

Bent portions R1, R2, and R3 and flat portions L1 and L2 are formed at the flat spring 7 in the present embodiment. The bent portion R1 is formed at about 90°; the bent portion R2, at an obtuse angle; and the bent portion R3, at an acute angle. Among the bent portions R1, R2, and R3, the bent portion R2 is bent with the largest change in angle in a case where the flat spring 7 is compressively deformed. The bent angle of the bent portion R2 becomes small when the flat spring 7 is compressively deformed. Reference symbol $\alpha$ designates the bend angle of the bent portion R2 in a case where the flat spring 7 is not compressively deformed, as indicated by solid lines in FIG. 10. Reference symbol $\beta$ designates the bend angle of the bent portion R2 in a case where the flat spring 7 is compressively deformed to the maximum, as indicated by broken lines in FIG. 10. The flat spring 7 is designed such that these angles $\alpha$ and $\beta$ satisfy the inequality of $(\alpha-\beta)>0$, so that the contact 12 and the inside contact pad 15 can be brought into contact with each other even in a case where the thickness T of a casing 1 is great.

Fifth Embodiment

Figure 11:
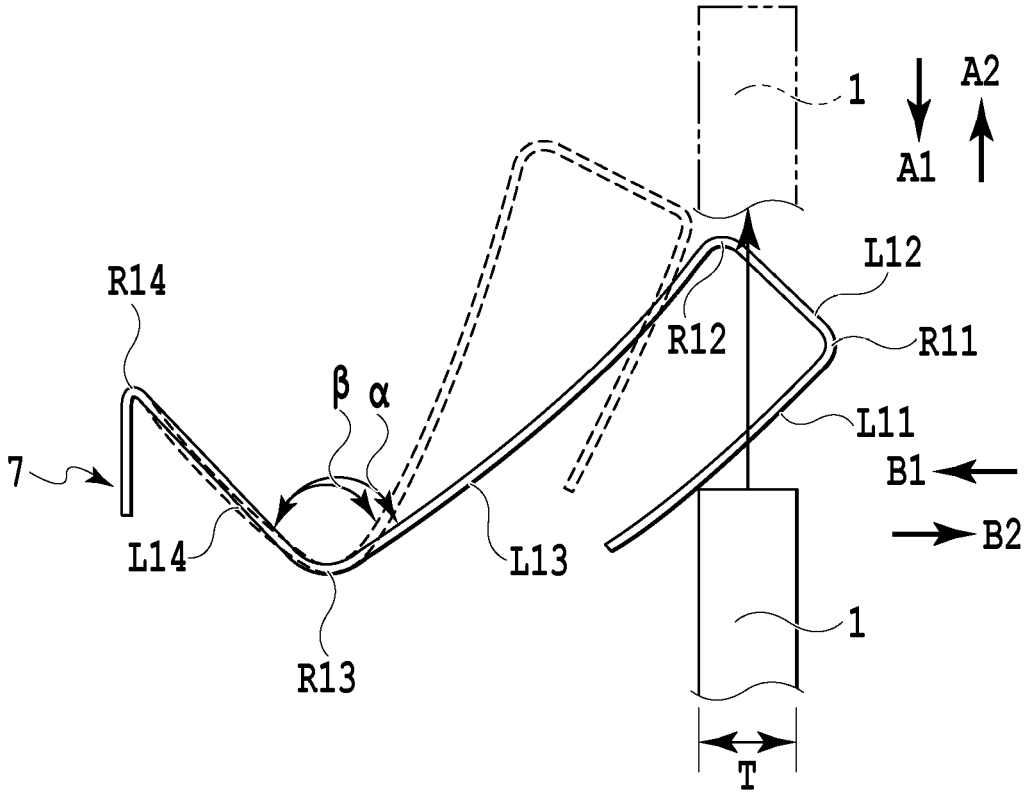
FIG. 11 is an explanatory view showing a flat spring in a fifth embodiment of the present invention.

FIG. 11 is an explanatory view showing a flat spring 7 in a fifth embodiment of the present invention.

Bent portions R11, R12, R13, and R14 and flat portions L11, L12, L13, and L14 are formed at the flat spring 7 in the present embodiment. The bent portions R11 and R12 are formed at about 90°; the bent portion R13, at an obtuse angle; and the bent portion R14, at an acute angle. The flat portion L11 is formed in such a manner as to be inclined relative to the direction in which the channel forming member 5 is incorporated (i.e., the direction indicated by the arrow A1). In incorporating the channel forming member 5, a portion (i.e., an abutment portion) of the flat portion L11 that abuts on the casing 1 is gradually shifted toward the bent portion R12. The flat portion L13 is turned on the bent portion R13 according to the shift at the abutment position of the flat portion L11 on the casing 1. Among the bent portions R11, R12, R13, and R14, the bent portion R13 is bent with the largest change in angle in a case where the flat spring 7 is compressively deformed. The bent angle of the bent portion R13 becomes small when the flat spring 7 is compressively deformed. Reference symbol $\alpha$ designates the bend angle of the bent portion R13 in a case where the flat spring 7 is not compressively deformed, as indicated by solid lines in FIG. 11. Reference symbol $\beta$ designates the bend angle of the bent portion R13 in a case where the flat spring 7 is compressively deformed to the maximum, as indicated by broken lines in FIG. 11. The flat spring 7 is designed such that these angles $\alpha$ and $\beta$ satisfy the inequality of $(\alpha-\beta)>0$, so that the contact 12 and the inside contact pad 15 can be brought into contact with each other.

Other Embodiments

In the above-described embodiments, the channel forming member 5 includes the electrode pin 6 that detects ink staying in the ink channel 18 and the flat spring 7 that is electrically connected to the electrode pin 6. The channel forming member 5 may be provided with various electric parts such as a light emitting device, a light receiving device, a temperature sensor, and an electric wire in addition to the electrode pin 6. The flat spring 7 may be electrically connected to these electric parts. Furthermore, a member provided with the above-described electric parts and the flat spring 7 is not limited to the channel forming member 5 forming the ink channel 18, and therefore, any members that are incorporated in the casing 1 so as to form the print head 100 may be used.

In addition, the print head according to the present invention may be used in various inkjet printing apparatus that may be of a so-called serial scanning system or full line system. Furthermore, the present invention is widely applicable to a liquid ejecting head capable of ejecting various kinds of liquid for subjecting various kinds of medium to various kinds of processing (such as printing, processing, coating, and inspecting).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-112730, filed May 30, 2014, and No. 2015-079181, filed Apr. 8, 2015, which are hereby incorporated by reference herein in their entirety.

What is claimed is:

1. A liquid ejecting head comprising:

a main body provided with an ejecting portion capable of ejecting liquid supplied through a liquid channel and an electric contact portion;

a channel forming member that is connected to the main body in a first direction so as to form the liquid channel; and a conductive flat spring that is fixed to the channel forming member and is brought into contact with the electric contact portion by a resilient restoring force in a case where the flat spring is deformed in a second direction crossing the first direction, wherein the flat spring is provided with an abutment portion that abuts on the main body so as to resiliently deform the flat spring in the second direction in a case where the channel forming member is connected to the main body in the first direction, and the flat spring includes a plurality of bent portions whose bend angles are changed in a case where the flat spring is resiliently deformed in the second direction.

2. The liquid ejecting head according to claim 1, wherein the flat spring includes a flat portion that is inclined relative to the first direction, and further, the abutment portion is positioned at the flat portion.

3. The liquid ejecting head according to claim 1, wherein the main body includes a through-hole that allows the flat spring to be deformed by the resilient restoring force.

4. The liquid ejecting head according to claim 3, wherein the flat spring is brought into contact with the electric contact portion through the through-hole.

5. The liquid ejecting head according to claim 4, wherein the electric contact portion is disposed at a wiring board, the wiring board being fixed to the main body such that the electric contact portion faces the through-hole.

6. The liquid ejecting head according to claim 1, wherein among the plurality of bent portions, there is a special bent portion whose bend angle is most largely changed in a case where the flat spring is connected to the main body, a bend angle of the special bent portion being reduced in the case where the flat spring is connected to the main body.

7. The liquid ejecting head according to claim 1, wherein the plurality of bent portions include a first bent portion whose bend angle is reduced in a case where the flat spring is connected to the main body and a second bent portion whose bend angle is increased in a case where the flat spring is resiliently deformed in the second direction, and the bent portion whose bend angle is most largely changed in the case where the flat spring is resiliently deformed in the second direction is the first bent portion.

8. A liquid ejecting head comprising:

a main body provided with an ejecting portion capable of ejecting liquid supplied through a liquid channel and an electric contact portion;

a channel forming member that is connected to the main body in a first direction so as to form the liquid channel; and a conductive flat spring that is fixed to the channel forming member and is brought into contact with the electric contact portion by a resilient restoring force in a case where the flat spring is deformed in a second direction crossing the first direction, wherein the flat spring is provided with an abutment portion that abuts on the main body so as to resiliently deform the flat spring in the second direction in a case where the channel forming member is connected to the main body in the first direction, and wherein the flat spring is electrically connected to an electrode pin provided on the channel forming member, the electrode pin configured to detect liquid in the liquid channel.

9. A liquid ejecting head comprising:

a main body provided with an ejecting portion capable of ejecting liquid supplied through a liquid channel and an electric contact portion;

a channel forming member that is connected to the main body in a first direction so as to form the liquid channel; and a conductive flat spring that is fixed to the channel forming member and is brought into contact with the electric contact portion by a resilient restoring force in a case where the flat spring is deformed in a second direction crossing the first direction, wherein the flat spring is provided with an abutment portion that abuts on the main body so as to resiliently deform the flat spring in the second direction in a case where the channel forming member is connected to the main body in the first direction, wherein the ejecting portion is provided with an ejection energy generating element configured to eject liquid, the main body is provided with a wiring board to be electrically connected to the electric contact portion and an element board to be electrically connected to the ejection energy generating element, and the wiring board and the element board are arranged at the same side of the main body.

10. The liquid ejecting head according to claim 9, wherein the wiring board and the element board are arranged within the same plane at the main body.

11. A fabricating method for a liquid ejecting head comprising a main body provided with an ejecting portion capable of ejecting liquid supplied through a liquid channel and an electric contact portion; a channel forming member that is connected to the main body in a first direction so as to form the liquid channel; and a flat spring that is fixed to the channel forming member and is brought into contact with the electric contact portion by a resilient restoring force in a case where the flat spring is deformed in a second direction crossing the first direction, the fabricating method comprising the step of:

allowing an abutment portion of the flat spring to abut the main body so as to resiliently deform the flat spring in the second direction in a case where the channel forming member is connected to the main body in the first direction, wherein a wiring board provided with the electric contact portion is fixed to the main body in the second direction, after the channel forming member is connected to the main body.

12. A fabricating method for a liquid ejecting head comprising a main body provided with an ejecting portion capable of ejecting liquid supplied through a liquid channel and an electric contact portion; a channel forming member that is connected to the main body in a first direction so as to form the liquid channel; and a flat spring that is fixed to the channel forming member and is brought into contact with the electric contact portion by a resilient restoring force in a case where the flat spring is deformed in a second direction crossing the first direction, the fabricating method comprising the step of:

allowing an abutment portion of the flat spring to abut the main body so as to resiliently deform the flat spring in the second direction in a case where the channel forming member is connected to the main body in the first direction, wherein a wiring board provided with the electric contact portion is fixed to the main body, before the channel forming member is connected to the main body.

13. A liquid ejecting head comprising:

a main body;

an ejecting portion capable of ejecting liquid supplied through a liquid channel;

an electric wiring board provided with a contact portion configured to receive a signal from the outside;

a channel forming member configured to form the liquid channel; and a conductive flat spring that is electrically connected to the contact portion, wherein the channel forming member is fixed to the main body via a fixing portion that is inserted into the main body in a first direction, and a through-hole penetrating in a second direction crossing the first direction is formed in the main body, the conductive flat spring being electrically connected to the contact portion through the through-hole in a resiliently deformed state in the second direction.

14. The liquid ejecting head according to claim 13, wherein the flat spring includes a plurality of bent portions whose bend angles are changed in a case where the flat spring is resiliently deformed in the second direction.

15. The liquid ejecting head according to claim 13, wherein the flat spring is fixed to the channel forming member.

16. The liquid ejecting head according to claim 15, wherein the flat spring is electrically connected to an electrode pin disposed on a channel at the channel forming member.

17. The liquid ejecting head according to claim 13, wherein a first electric wiring board to be electrically connected to the ejecting portion and a second electric wiring board including the contact portion are provided at one surface of the main body.

* * * * *